United States Patent [19]

Kuehn et al.

[11] Patent Number: 4,818,982

[45] Date of Patent: Apr. 4, 1989

[54] BRIGHTNESS CONTROL FOR AN ELECTRO-LUMINESCENT DISPLAY

[75] Inventors: Gary Kuehn, Waldorf, Md.; David M. Gerrek, Chesapeake; Wendy Ferguson, Virginia Beach, both of Va.

[73] Assignee: Systems Management American Corporation, Norfolk, Va.

[21] Appl. No.: 84,202

[22] Filed: Aug. 12, 1987

[51] Int. Cl.[4] ..... G09G 3/00

[52] U.S. Cl. ..... 340/793; 340/767; 340/771; 340/781

[58] Field of Search ..... 340/793, 767, 771, 781, 340/723; 315/169.1, 169.3, 169.4; 358/230, 240, 241

[56] References Cited

U.S. PATENT DOCUMENTS 4,340,889 7/1982 Knight et al. ..... 340/793

4,486,747 12/1984 Okamoto et al. ..... 340/793

4,554,539 11/1985 Graves ..... 340/793

4,725,833 2/1988 Nakamura ..... 340/793

*Primary Examiner*—Gerald L. Brigance

*Assistant Examiner*—Jeffery A. Brier

*Attorney, Agent, or Firm*—Cushman, Darby & Cushman

[57] ABSTRACT

A brightness control circuit for use with Plasma and Electroluminescent displays. The circuit receives from a computer, or other driving device, video data to be displayed, an intensity signal indicating the intensity with which to display data, a video clock and horizontal and vertical sync signals. The circuit generates first and second video fields, each having some data removed from the fields defined by the input video signal. These fields are combined to form frame data which is then modulated by the intensity signal. The result is modified video data for coupling to the display which can cause the display to display data at a low intensity.

7 Claims, 4 Drawing Sheets

BRIGHTNESS CONTROL FOR AN ELECTRO-LUMINESCENT DISPLAY

BACKGROUND OF THE INVENTION (a) Field of the Invention

This invention relates in general to electronic displays. More specifically, it relates to Plasma and AC/DC Electroluminescent (EL) displays and provides brightness control for such Plasma and AC/DC Electroluminescent displays.

(b) Description of the Prior Art

With the increased use of portable personal computers, Plasma and Electroluminescent displays are becoming more popular. Many software applications such as, for example, word processing, spreadsheet, and computer aided design, use half/full intensity attributes of a video output to highlight important data or convey information to the user. Intensity control of a conventional cathode ray tube (CRT) is well known. There are now standard circuit arrangements for controlling the intensity (brightness) of a CRT.

However, Plasma and Electroluminescent displays "off the shelf" that are integrated into personal computers, and the like, do not have intensity control. When such displays are utilized for the video output of a software package that calls for brightness control to convey some information to the user, that information is not conveyed. The user will not, for example, see "highlighted" data that would be apparent if the data were displayed on a conventional CRT.

SUMMARY OF THE INVENTION

The present invention provides a circuit that can be used in conjunction with conventional Plasma and Electroluminescent displays to provide half/full intensity on the display. It will be referred to also by the name "'Half Intensity Circuit". By using the Half Intensity Circuit of the invention, highlighted data will appear highlighted on the display, and it requires no modification whatsoever to the display. The invention is preferably embodied as a circuit card that is interposed in circuit between a video driver and the display. It allows for selective control of intensity through implementation of digital logic operating on the "INTENSITY" signal generated by the personal computer's graphic video card that would normally drive the computer's display.

A typical use of the Half Intensity Circuit according to the present invention would be in a computer that includes a video card having RGB and intensity outputs operating with NTSC standard horizontal and vertical timing.

DETAILED DESCRIPTION OF THE PREFERRED EMBODIMENT

Figure 1:
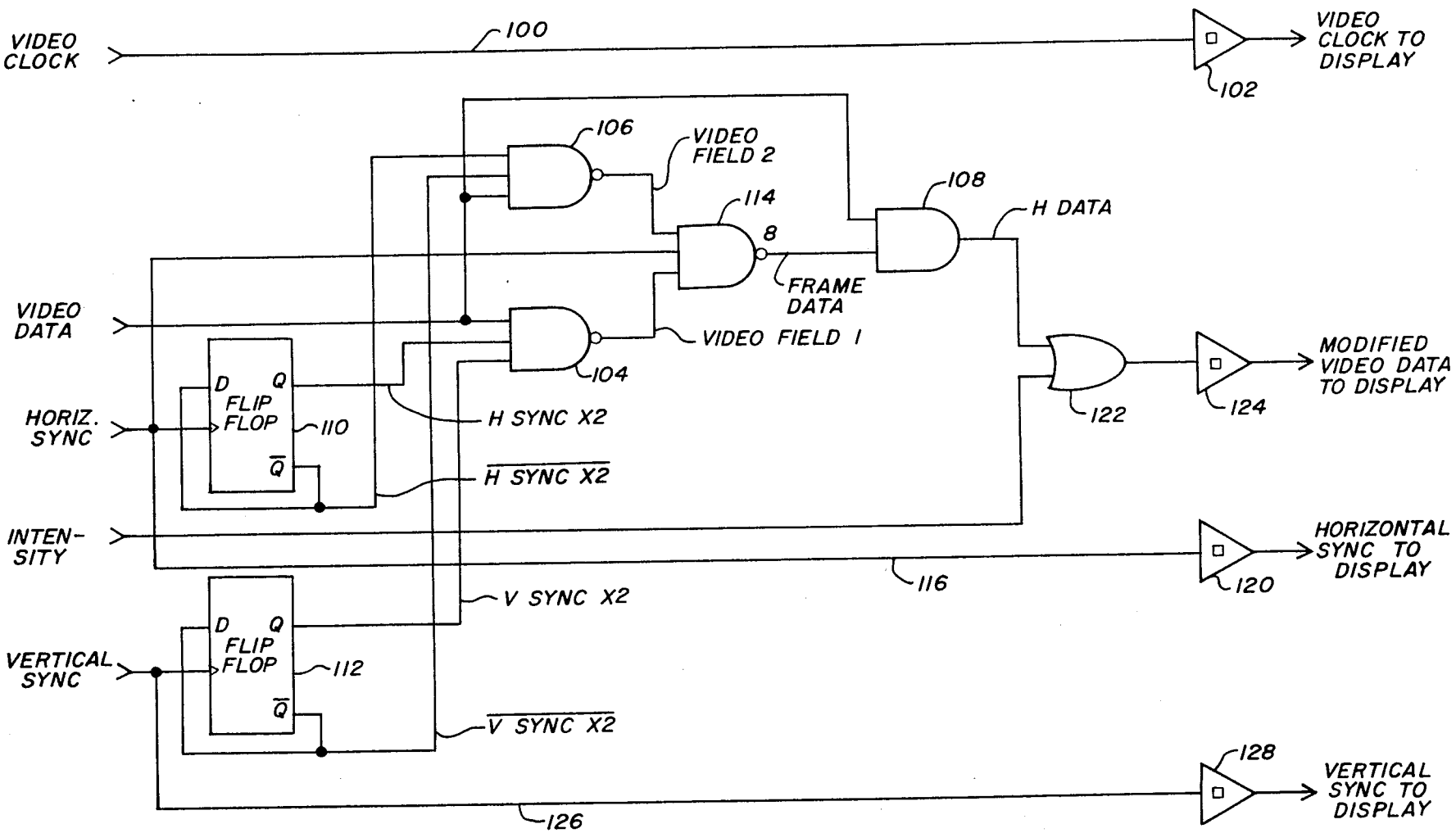
FIG. 1 is a schematic diagram of the Half Intensity circuit according to the present invention.

FIG. 1 is a schematic diagram of the Half Intensity Circuit according to the present invention. Input signals to the Half Intensity Circuit are shown at the left side of the figure. The "VIDEO CLOCK" signal is 14.3180 MHz. This signal is not used per se by the Half Intensity Circuit. However, it must be passed along to the display, for most Plasma and Electroluminescent displays use a 14.3180 MHz. signal as a sampling frequency. The "HORIZONTAL SYNC" AND "VIDEO DATA" signals must be synchronized with the VIDEO CLOCK signal.

The VIDEO DATA signal is positive RGB video data from a video driver (not shown). Typically, the active video portion is 50.8 μsec. The HORIZONTAL SYNC signal has a period of 63.5 μsec. and a 0 (zero) state = 12.7μ sec. The VERTICAL SYNC signal has a period of 16.7 msec. and a 0 (zero) state = 63.5 μsec. The 0 (zero) state time of 12.7 μsec. represents a typical period rather than an absolute requirement. This parameter may be defined differently for various Plasma and Electroluminescent displays. The use of a different period will not change the functionality of the Half Intensity Circuit.

The VIDEO CLOCK signal is passed directly from its input at the left side of FIG. 1 via a signal line 100 to a line driver 102. Line driver 102 is preferably constituted by an LS241 circuit, which provides a video clock signal to the display. The VIDEO DATA signal is coupled to a first input of a first three input NAND gate 104. NAND gate 104 is preferably constituted by a 74LS10 circuit. The VIDEO DATA signal is also coupled to a first input of a second three input NAND gate 106 and to a first input of a two input AND gate 108. The HORIZONTAL SYNC signal is coupled to the input of a first D-type flip flop 110. The "Q" output of D-type flip flop 110 is coupled to a second input of first NAND gate 104. The $\overline{Q}$ output of D-type flip flop 110 is coupled to the "D" input of D-type flip flop 110 and to a second input of second NAND gate 106.

The VERTICAL SYNC signal is coupled to the input of a second D-type flip flop 112. The "Q" output of D-type flip flop 112 is coupled to a third input of first NAND gate 104. The $\overline{Q}$ output of D-type flip flop 112 is coupled to the "D" input of D-type flip flop 112 and to a third input of second NAND gate 106. The HORIZONTAL SYNC signal is also coupled to a first input of a third NAND gate 114. The second and third inputs of NAND gate 114 are respectively coupled to the outputs of second NAND gate 106 and first NAND gate 104. The HORIZONTAL SYNC signal is also coupled via a signal line 116 to a second line driver 120 preferably constituted by an LS241 circuit, which provides a horizontal sync signal to the display. The output of third NAND gate 114 is coupled to a second input of AND gate 108. The output of AND gate 108 is coupled to a first input of an OR gate 122, the second input of which is coupled to receive the INTENSITY signal. The output of OR gate 122 is coupled to a third line driver 124, which provides modified video data to the display. The VERTICAL SYNC signal is also coupled via a signal line 126 directly to a fourth line driver 128, which provides a vertical sync signal to the display.

Figure 3:
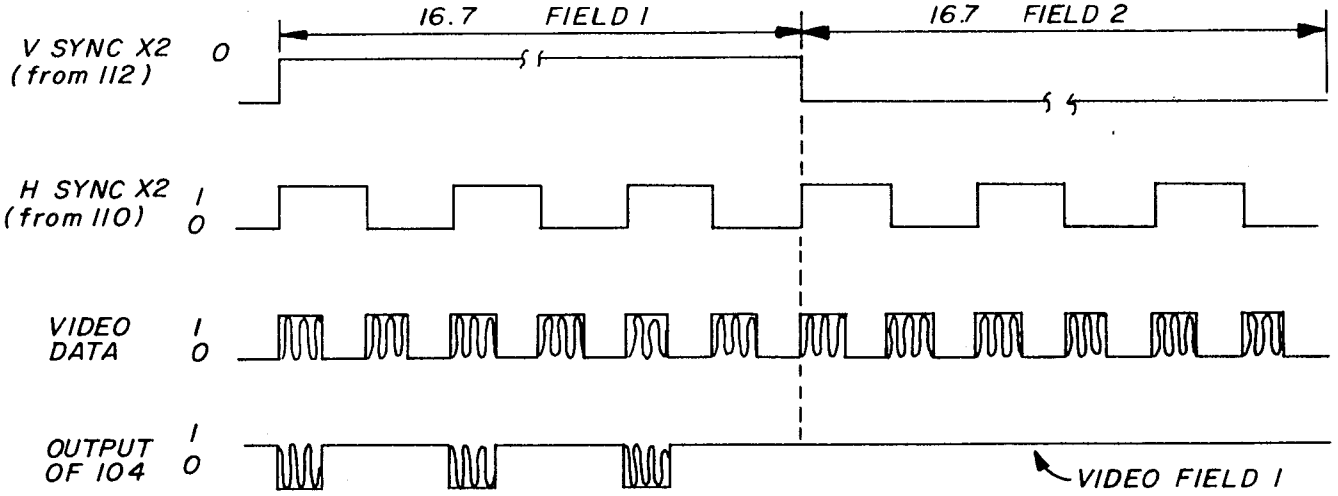
FIG. 3 is a timing diagram showing input and output signals of gate 104.
Figure 4:
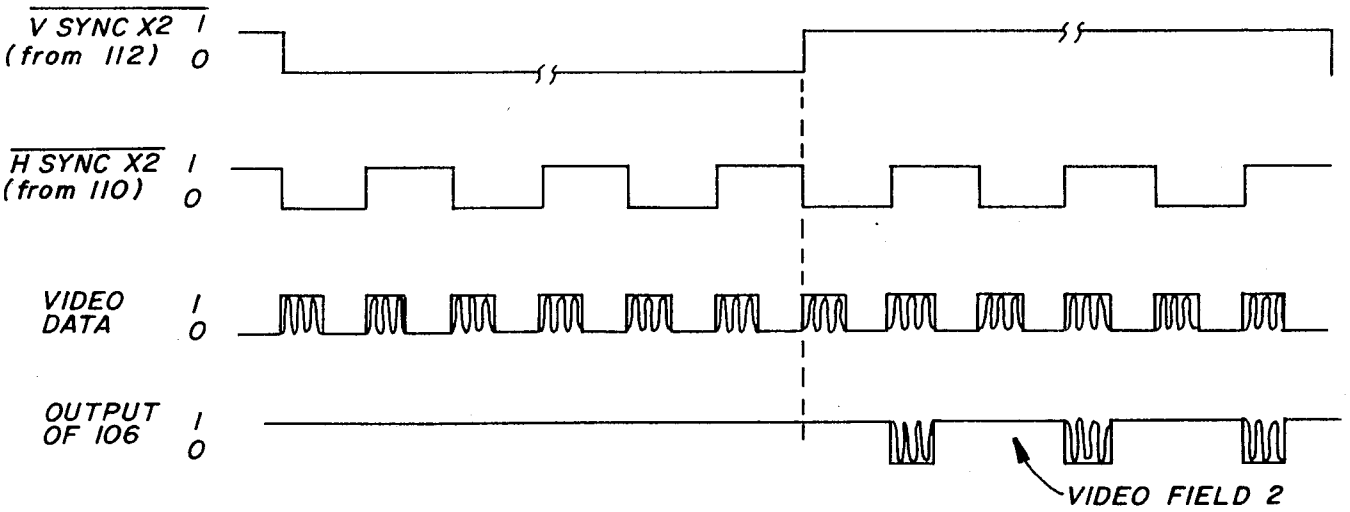
FIG. 4 is a timing diagram showing input and output signals of gate 106.

Both periods of the HORIZONTAL SYNC and VERTICAL SYNC signals are increased by a factor of two by utilizing D-type flip flop 110 and D-type flip flop 112 (see FIGS. 3 and 4). The outputs of D-type flip flop 110 and D-type flip flop 112 are used to gate every other video data lines by using the three input NAND gates. The outputs of first NAND gate 104 and second NAND gate 106 represent the video data associated with field 1 and field 2. Third NAND gate 114 assembles the two video fields into frame data (see FIGS. 5 and 6). AND gate 108 ensures every other video data line is present at the input to OR gate 122. OR gate 122 assembles every other video data line with intensity pulses that occur on every line. The output is every other video line without intensity pulses and every line with intensity pulses at that line time (see FIG. 7). Since the display is only excited with every other video data line, the display visually appears dim.

Figure 2:
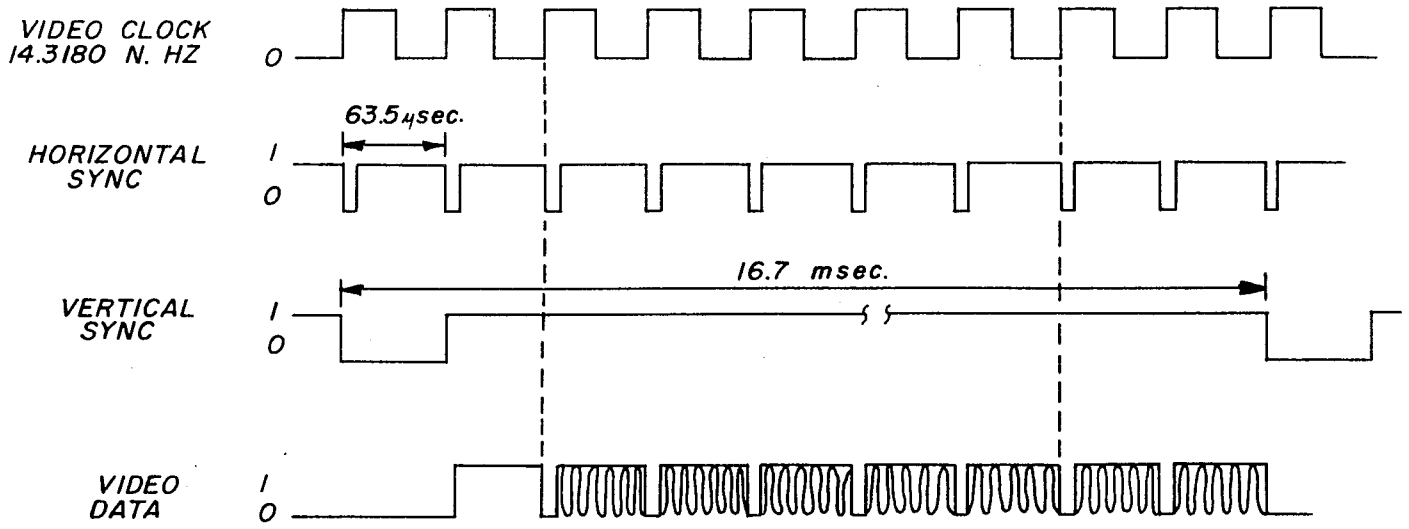
FIG. 2 is a timing diagram showing various input signals to the Half Intensity Circuit according to the present invention.

FIG. 2 is a timing diagram showing various input signals to the Half Intensity Circuit according to the present invention. The signals diagrammed in FIG. 2 are input at the left side of the Half Intensity Circuit shown in FIG. 1. As shown in the diagram, there are a plurality of horizontal sync pulses between vertical sync pulses. The video clock is generated externally to the Half Intensity Circuit. The video data signal may be an analog signal that exists within each of the time window blocks shown in the Figure.

FIG. 3 is a timing diagram showing input and output signals of gate 104 and FIG. 4 is a timing diagram showing input and output signals of gate 106. Each video frame includes first and second fields (field 1 and field 2). Comparing the output of gates 104 and 106, it is clear that circuit eliminates some of the video data from its respective field.

Figure 5:
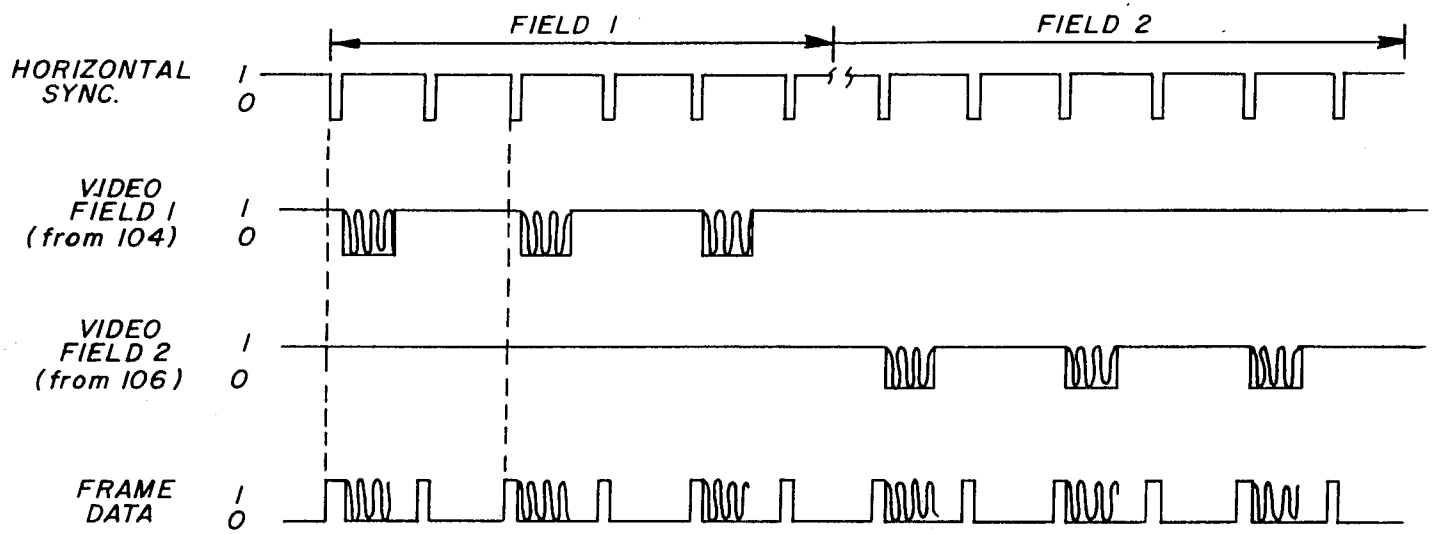
FIG. 5 is a timing diagram showing input and output signals of gate 114.

FIG. 5 is a timing diagram showing input and output signals of gate 114. The outputs of gates 104 and 106 are produced adjacent one another to illustrate how those signals are used to construct the "frame data" shown on the bottom line of FIG. 5 (the output of gate 114).

Figure 6:
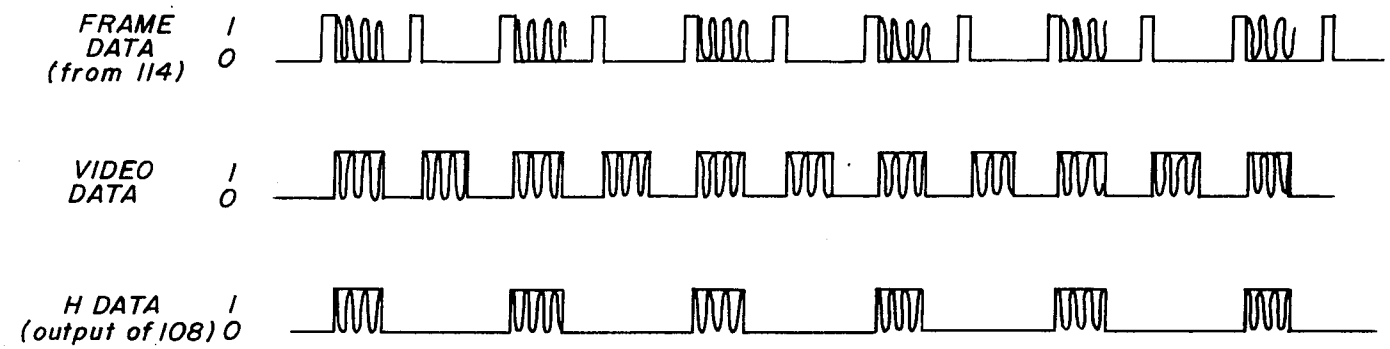
FIG. 6 is a timing diagram showing input and output signals of gate 108.

FIG. 6 is a timing diagram showing input and output signals of gate 108. The output of gate 108 constitutes "half intensity" data which is input to gate 122.

Figure 7:
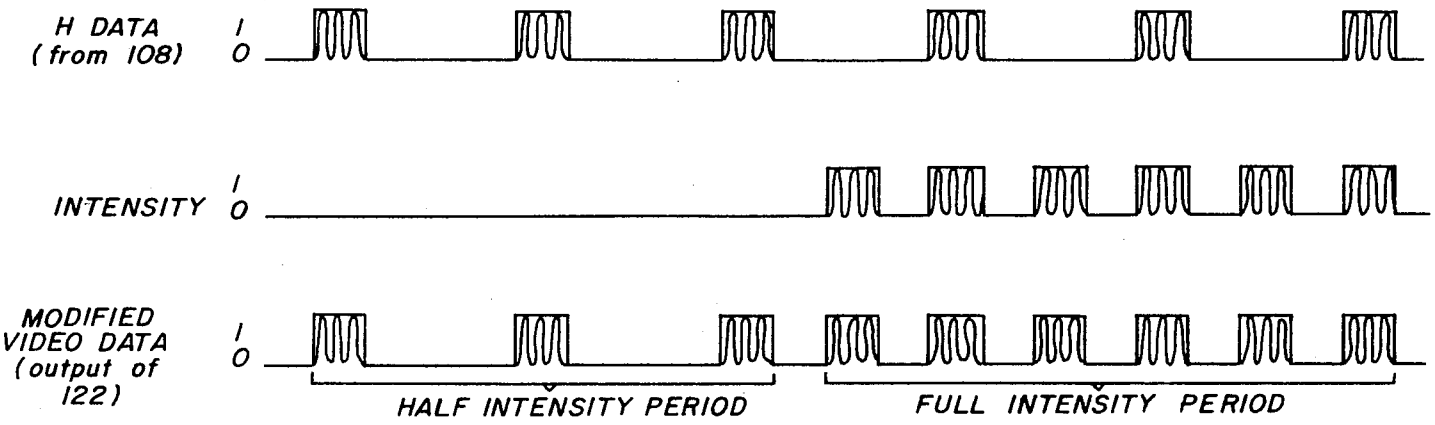
FIG. 7 is a timing diagram showing input and output signals of gate 122.

FIG. 7 is a timing diagram showing input and output signals of gate 122. In gate 122, the half intensity data from gate 108 is combined with the intensity signal input to the Half Intensity Circuit to produce, via third line driver 124, a modified video data for driving the display. Low intensity is achieved by "exciting" the display less often for a given frame of data to be displayed. Although theoretically there is a loss of data, the data rate for a computer display is so high that the human eye can't keep up with it anyway. Hence, there is no loss of data apparent to the viewer.

Alternative embodiments include circuitry for achieving compatibility with a composite analog video signal and circuits for accommodating high resolution and enhanced graphics horizontal timing.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

We claim:

1. A brightness control circuit for use with Plasma and Electroluminescent displays, comprising:

means for receiving from a data source an input video data signal including video data to be displayed on a display, an input horizontal sync pulse signal for horizontally synchronizing said display, an input vertical sync signal for vertically synchronizing said display, an input video clock for establishing a reference for the video data, and an input intensity signal for indicating whether particular video data is to be displayed at a low or a high intensity by said display;

means, coupled to said receiving means, for generating first and second video data fields each of which includes less data than its respective field component in said video data signal;

means for combining said first and second video data fields to form frame data;

means, coupled to said combining means, for receiving said video data and said frame data and for providing half intensity data; and means for modulating said half intensity video data with said intensity signal to provide modified video data for selectively driving said display at full intensity when said intensity signal indicates that particular video data is to be displayed at a high intensity and at half intensity when said intensity signal indicates that particular video data is to be displayed at a low intensity.

2. A circuit according to claim 1 wherein said means for generating first and second video data fields comprises:

means for generating intermediate vertical sync signals having twice the period of said input vertical sync signal;

means for generating intermediate horizontal sync signals having twice the period of said input horizontal sync signal;

means for receiving said video data and said intermediate horizontal and vertical sync signals and providing in response thereto, said first and second video fields.

3. A circuit according to claim 1 wherein said generating means comprises:

a first flip-flop circuit clocked by said horizontal sync signal, having a Q output and a output coupled to a D input thereof;

a second flip-flop circuit clocked by said vertical sync signal, having a Q output and a output coupled to a D input thereof;

a first three input NAND gate having a first input coupled to said output of said first flip-flop, a second input coupled to said output of said second flip-flop and a third input coupled to receive said video data signal, said first NAND gate providing, at its output, said second video field; and a second three input NAND gate having a first input coupled to said Q output of said first flip-flop, a second input coupled to said Q output of said second flip-flop and a third input coupled to receive said video data signal, said second NAND gate providing, at its output, said first video field.

4. A circuit according to claim 3 wherein said combining means comprises a three input NAND gate having a first input coupled to said first NAND gate output, a second input coupled to said second NAND gate output and a third input coupled to said horizontal sync signal for providing said frame data at its output.

5. A circuit according to claim 4 wherein said means for providing half intensity data comprises a two input AND gate having a first input coupled to said video data signal and a second input coupled to receive said frame data from said third NAND gate.

6. A circuit according to claim 5 wherein said modulating means comprises a two input OR gate having a first input coupled to said half intensity data and a second input coupled to said intensity signal, said OR gate providing, at its output, said modified video data for coupling to said display.

7. A circuit according to claim 6 further including an amplifier for amplifying said modified video data before it is coupled to said display.

* * * * *